US012655840B2

(12) United States Patent
Venne et al.

(10) Patent No.: US 12,655,840 B2
(45) Date of Patent: Jun. 16, 2026

(54) VIBRATION STABILIZER ASSEMBLY FOR A COMPRESSOR IN A TRANSPORT REFRIGERATION UNIT

(71) Applicant: Carrier Corporation, Palm Beach Gardens, FL (US)

(72) Inventors: Samuel Venne, Brewerton, NY (US); Parmesh Verma, Manlius, NY (US); Ahmed Elbanna, East Syracuse, NY (US); Mark Hooker, Ry (FR); Mickael Saint-Denis, Ailly (FR); Lester Harrington, Lafayette, NY (US); Eric Johnson, Auburn, NY (US); Isabelle Pierre-Danos, Le Mesnil Esnard (FR); Philippe Vaas, Mesnil Raoul (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 12 days.

(21) Appl. No.: 18/807,063

(22) Filed: Aug. 16, 2024

(65) Prior Publication Data

US 2025/0075693 A1 Mar. 6, 2025

Related U.S. Application Data

(60) Provisional application No. 63/535,927, filed on Aug. 31, 2023.

(51) Int. Cl.

| | |
|---|---|
| ***F16M 13/02*** | (2006.01) |
| ***F04B 53/00*** | (2006.01) |
| ***F25B 31/00*** | (2006.01) |

(52) U.S. Cl.
CPC ..... *F04B 53/003* (2013.01); *F25B 31/00* (2013.01); *F25B 2500/13* (2013.01)

(58) Field of Classification Search
CPC .... F04B 53/003; F25B 31/00; F25B 2500/13; F16F 15/08; F16F 1/3735; B65D 81/05; B65D 85/68; B65D 2585/6875
See application file for complete search history.

(56) References Cited

U.S. PATENT DOCUMENTS

| | | | | |
|---|---|---|---|---|
| 5,306,121 | A * | 4/1994 | Heflin | F16F 15/08 417/363 |
| 6,004,113 | A | 12/1999 | Vay | |
| 6,132,183 | A | 10/2000 | Li et al. | |
| 6,352,247 | B1 | 3/2002 | Ishikawa et al. | |

(Continued)

FOREIGN PATENT DOCUMENTS

| | | | |
|---|---|---|---|
| CN | 219082151 | U | 5/2023 |
| DE | 102019115263 | B4 | 8/2022 |

(Continued)

OTHER PUBLICATIONS

Extended European Search Report received for EP Application No. 24197764.4, mailed on Aug. 1, 2025, 7 Pages.

*Primary Examiner* — Amy J. Sterling
(74) *Attorney, Agent, or Firm* — Souad Hakim

(57) ABSTRACT

A vibration stabilizer assembly for a compressor in a transport refrigeration unit (TRU) is disclosed. The assembly comprises a plurality of first buffers configured between a bottom plate associated with the compressor and a frame of the TRU, where each of the first buffers has a radial stiffness of less than 1000 pounds per inch.

19 Claims, 9 Drawing Sheets

(56) References Cited

U.S. PATENT DOCUMENTS

| | | | | |
|---|---|---|---|---|
| 6,354,558 | B1 * | 3/2002 | Li | F16F 1/3732 248/673 |
| 6,543,741 | B1 | 4/2003 | Li et al. | |
| 11,754,142 | B2 * | 9/2023 | Hoffman | F16F 15/08 29/428 |
| 2004/0113339 | A1 * | 6/2004 | Masterson | F16F 15/08 267/153 |
| 2005/0186092 | A1 * | 8/2005 | Lee | F16F 7/104 417/363 |
| 2009/0152032 | A1 | 6/2009 | Klotten et al. | |
| 2019/0376499 | A1 | 12/2019 | Doeden et al. | |
| 2022/0186809 | A1 | 6/2022 | Horibe et al. | |

FOREIGN PATENT DOCUMENTS

| | | | |
|---|---|---|---|
| EP | 3686429 | B1 | 4/2023 |
| JP | S5891384 | A | 5/1983 |
| JP | S58101273 | A | 6/1983 |
| JP | S6336429 | B2 | 7/1988 |
| JP | H08326811 | A | 12/1996 |
| KR | 0117775 | Y1 | 7/1998 |
| WO | 2016147785 | A1 | 9/2016 |
| WO | 2018155001 | A1 | 8/2018 |

* cited by examiner

VIBRATION STABILIZER ASSEMBLY FOR A COMPRESSOR IN A TRANSPORT REFRIGERATION UNIT

CROSS-REFERENCE TO RELATED APPLICATION

This patent application claims the benefit of U.S. Provisional Patent Application No. 63/535,927, filed on Aug. 31, 2023, which is incorporated by reference herein in its entirety.

BACKGROUND

This invention relates to the field of transport refrigeration units, and more particularly, a vibration stabilizer assembly for a compressor in a transport refrigeration unit.

SUMMARY

Described herein is a vibration stabilizer assembly for a compressor in a transport refrigeration unit (TRU). The assembly comprises a plurality of first buffers configured between a bottom plate associated with the compressor and a frame of the TRU, wherein each of the first buffers has a radial stiffness of less than 1000 pounds per inch.

In one or more embodiments, the first buffers have a radial stiffness of less than 600 pounds per inch. Further, in one or more embodiments, the first buffers have a radial stiffness of less than 400 pounds per inch. In one or more embodiments, each of the first buffers has an axial-to-radial stiffness ratio of 2:1, 3:1, or 4:1.

In one or more embodiments, wherein each of the first buffers comprises a first member comprising a first cylindrical base with a radially extending first flange and a centrally located first annular section extending along a center axis of the first member. Each of the first buffers further comprises a second member comprising a second cylindrical base with a radially extending second flange, and a centrally located second annular section extending along a center axis of the first member. The first member is coaxially configured with the second member such that the first cylindrical base and the second cylindrical base remain in contact, and the first annular section and the second annular section remain in line.

In one or more embodiments, each of the first buffers comprises a rigid sleeve configured coaxially and extending longitudinally through the first annular section and the second annular section of the corresponding first buffer.

In one or more embodiments, the assembly comprises a bolt extending through the rigid sleeve associated with each of the first buffers such that a head of the bolt rests on top of the first flange, a free end of the bolt extends at least partially outside from a bottom of the frame through the second flange, and the rigid sleeve extends between a bottom of the head of the bolt and a top surface of the frame, and wherein the free end of the bolt is fastened using a nut to secure the corresponding first buffer to the bottom plate and the frame.

In one or more embodiments, the assembly comprises a plurality of first holes at first predefined positions on the bottom plate, and a plurality of second holes at second predefined positions on the frame of the TRU, wherein the first holes of the bottom plate and the second holes of the frame are aligned in line to facilitate fastening of the plurality of first buffers to the bottom plate and the frame via the bolt and the nut.

In one or more embodiments, each of the first buffers is fastened to the bottom plate and the frame such that a rim area, around the first hole, of the corresponding bottom plate rests between the first flange and the second flange, around the first cylindrical base and the second cylindrical base, while preventing contact between the bottom plate and the frame.

In one or more embodiments, the assembly comprises a spacer of a first thickness configured between a bottom surface of the rim area and a top surface of the second flange.

In one or more embodiments, the assembly comprises a first washer configured between the first flange and the head of the bolt, and a second washer of a second thickness configured between the second flange and a top surface of the frame, wherein the second thickness is selected based on a gap between the bottom of the second flange and the frame, wherein the rigid sleeve extends between the first washer and the second washer.

In one or more embodiments, the assembly comprises an annular filler disposed of in the plurality of second holes, wherein the annular filler is configured to allow the bolt to extend therethrough while restricting movement of the bolt with respect to the frame in the corresponding second hole.

In one or more embodiments, the assembly comprises one or more clamping rings extending around a top end of the compressor and connected to each other, and a mounting plate coupled to at least one of the clamping rings and the frame of the TRU, wherein the mounting plate is coupled to the corresponding clamping ring using at least one second buffer, wherein the second buffer has a radial stiffness of less than 1000 pounds per inch.

Further described herein is a vibration stabilizer assembly for a compressor in a transport refrigeration unit (TRU). The assembly comprises one or more clamping rings extending around a top end of the compressor and connected to each other and a mounting plate coupled to at least one of the clamping rings and a frame of the TRU, wherein the mounting plate is coupled to the corresponding clamping ring using at least one second buffer, wherein the at least one second buffer has a radial stiffness of less than 1000 pounds per inch.

In one or more embodiments, the at least one second buffer has an axial-to-radial stiffness ratio of 6:1.

In one or more embodiments, two ends of the mounting plate are coupled to the corresponding clamping ring using a pair of the second buffers, wherein the mounting plate is further coupled to the frame using a fastener.

In one or more embodiments, the assembly comprises a plurality of first buffers configured between a bottom plate associated with the compressor and the frame of the TRU, wherein each of the first buffers has a radial stiffness of less than 1000 pounds per inch.

In one or more embodiments, each of the first buffers has an axial stiffness ranging from 4000 to 600 pounds per inch and the radial stiffness ranging from 1000 to 300 pounds per inch, and wherein the at least one second buffer has an axial stiffness ranging from 6000 to 600 pounds per inch and the radial stiffness ranging from 1000 to 200 pounds per inch.

In one or more embodiments, the at least one second buffer is a stud mount comprising a base plate and a stud element protruding perpendicularly from the base plate.

The foregoing summary is illustrative only and is not intended to be in any way limiting. In addition to the illustrative aspects, embodiments, and features described above, further aspects, embodiments, features, and techniques of the subject disclosure will become more apparent from the following description taken in conjunction with the drawings.

BRIEF DESCRIPTION OF THE DRAWINGS

The accompanying drawings are included to provide a further understanding of the subject disclosure and are incorporated in and constitute a part of this specification. The drawings illustrate exemplary embodiments of the subject disclosure and, together with the description, serve to explain the principles of the subject disclosure.

In the drawings, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label.

DETAILED DESCRIPTION

Figure 1A:
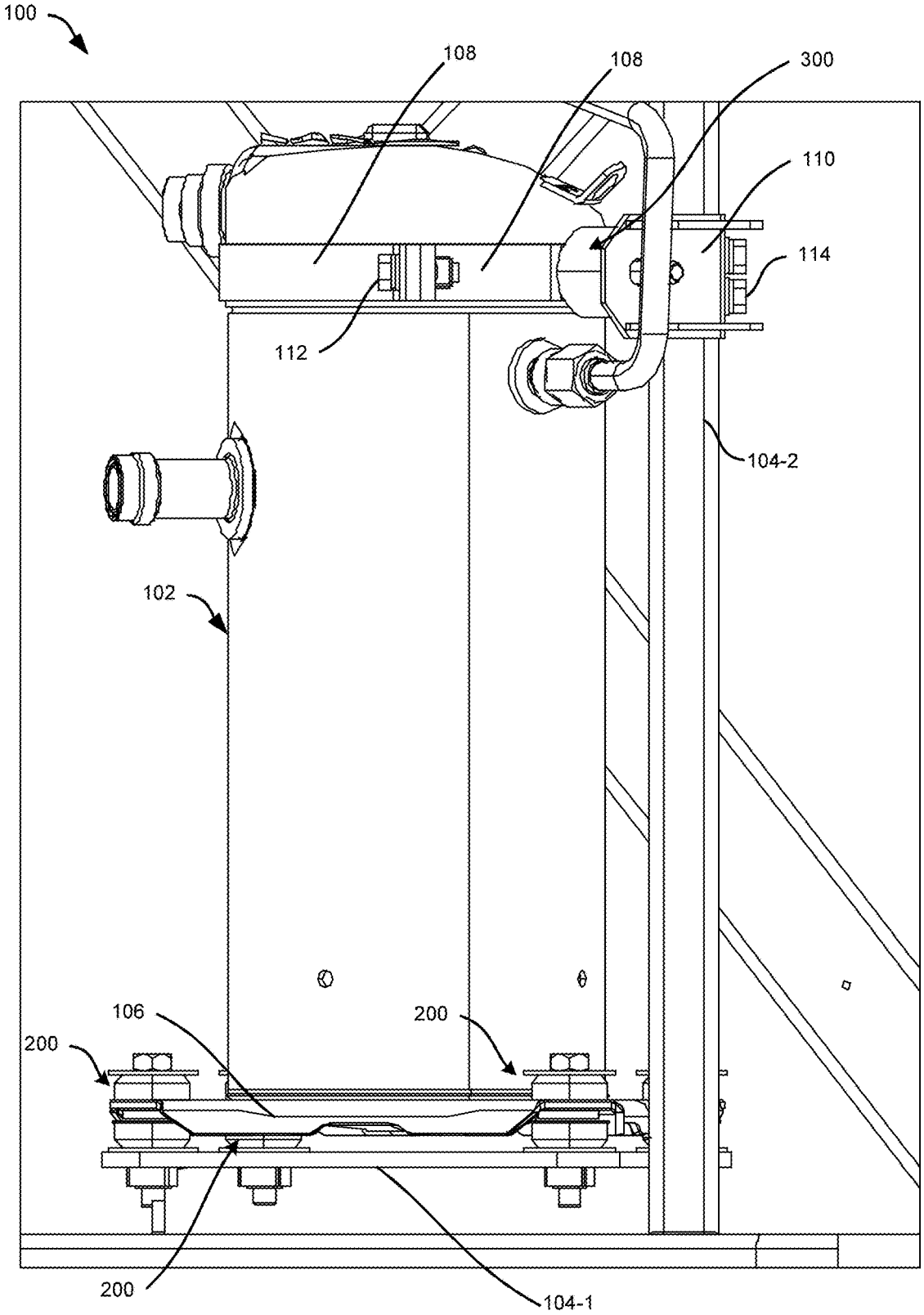
FIGS. 1A to 1D illustrate exemplary views of the vibration stabilizer assembly configured with a compressor in a TRU in accordance with one or more embodiments of the subject disclosure.
Figure 1B:
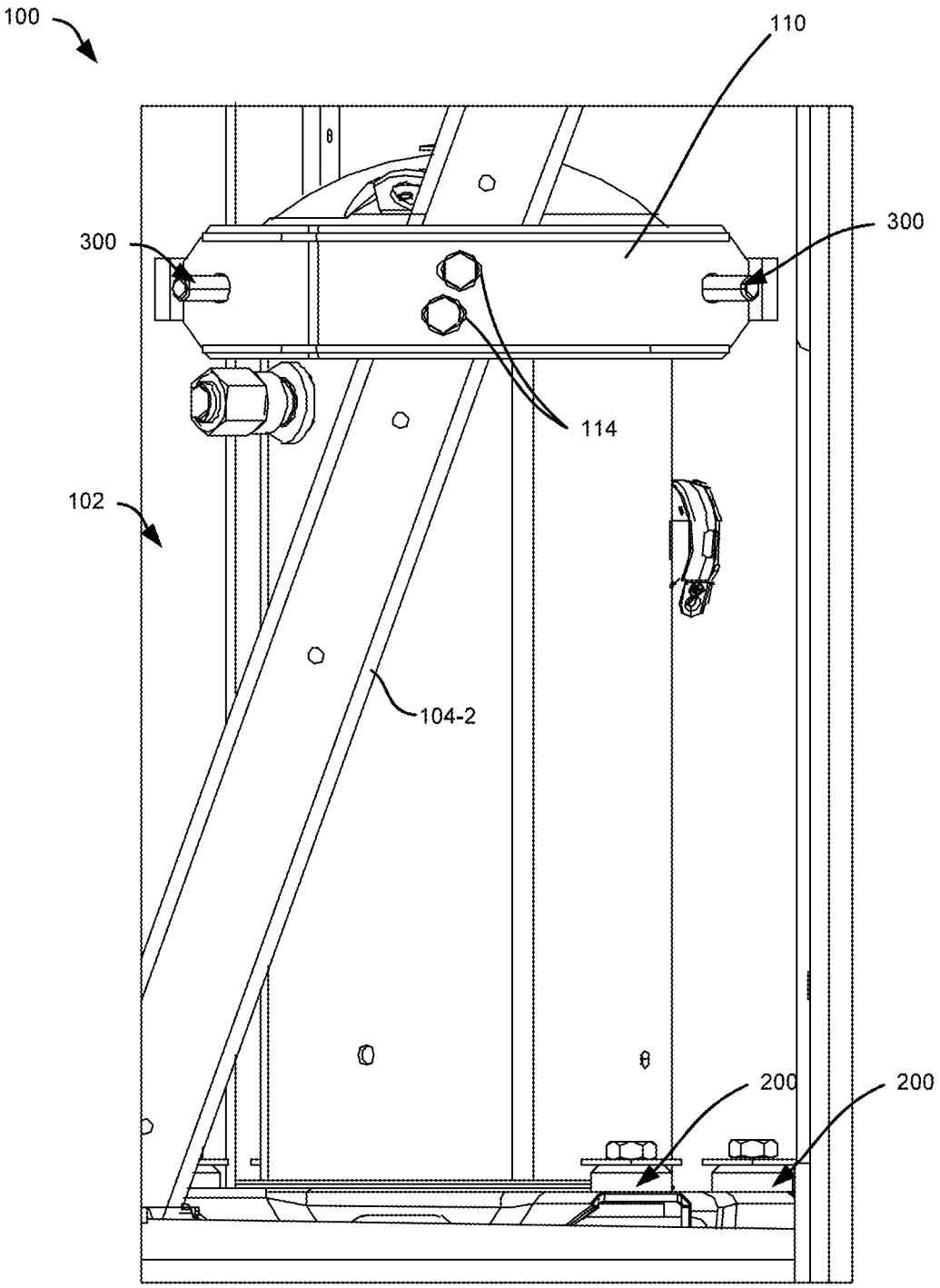
Figure 1C:
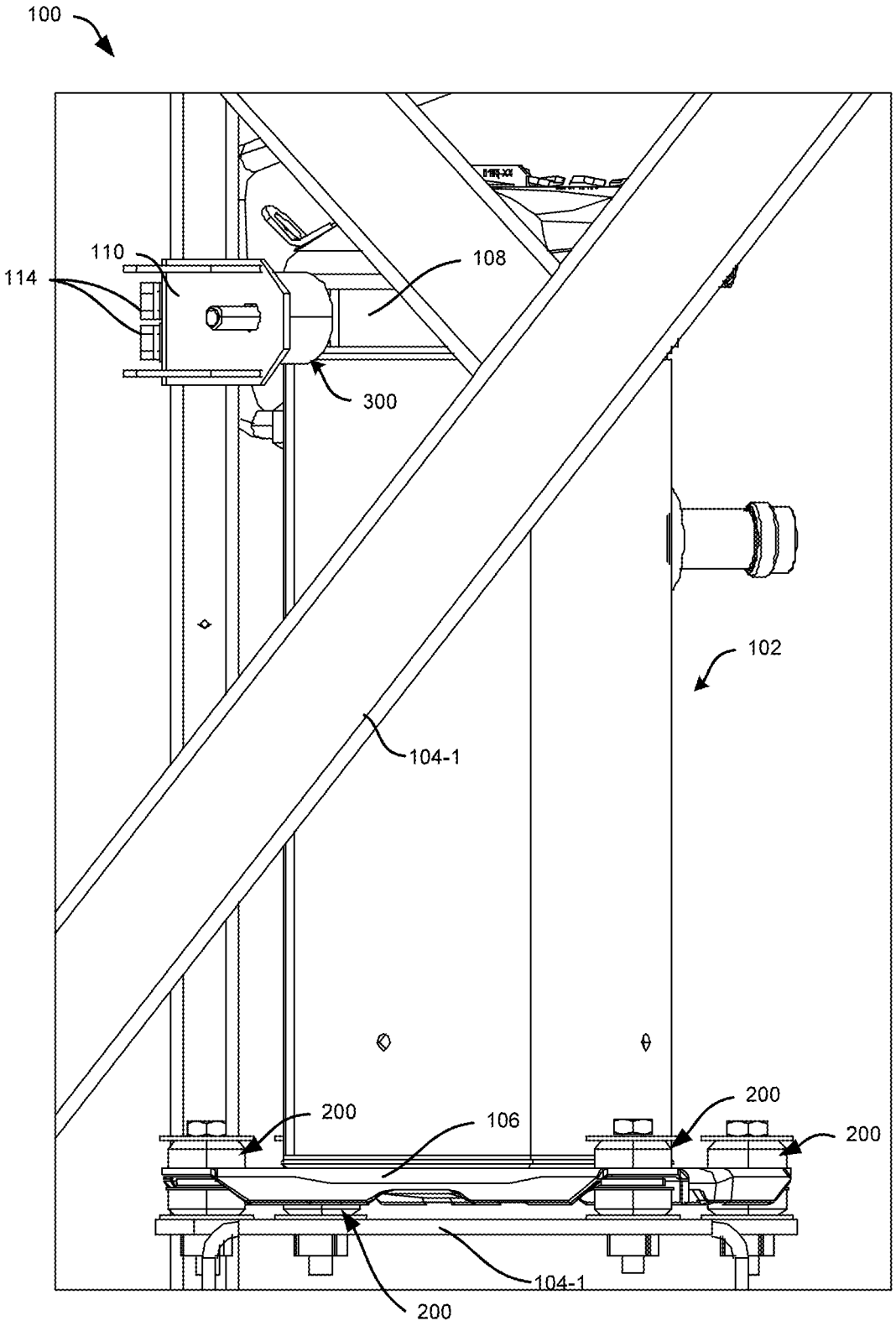
Figure 1D:
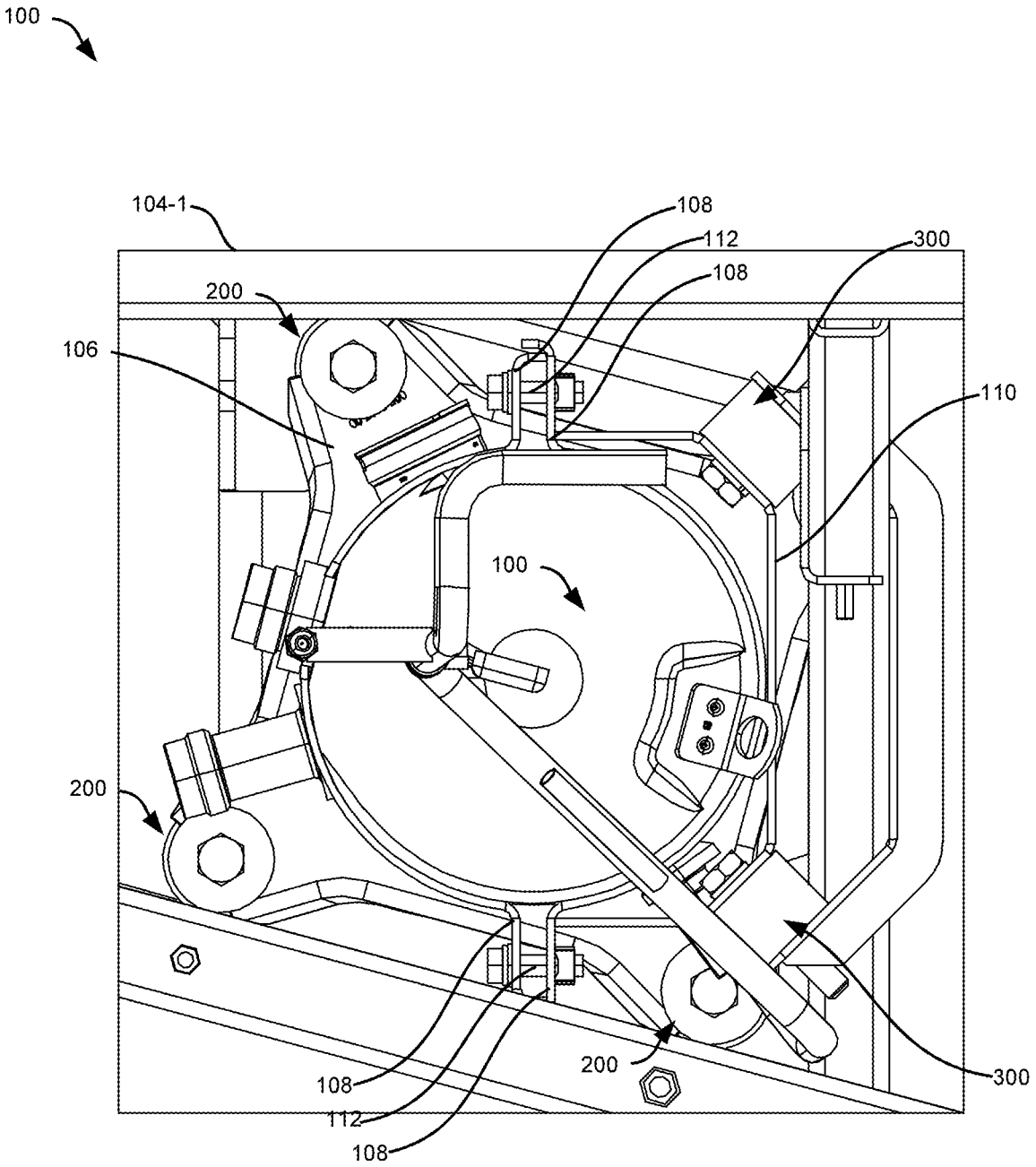
Figure 2A:
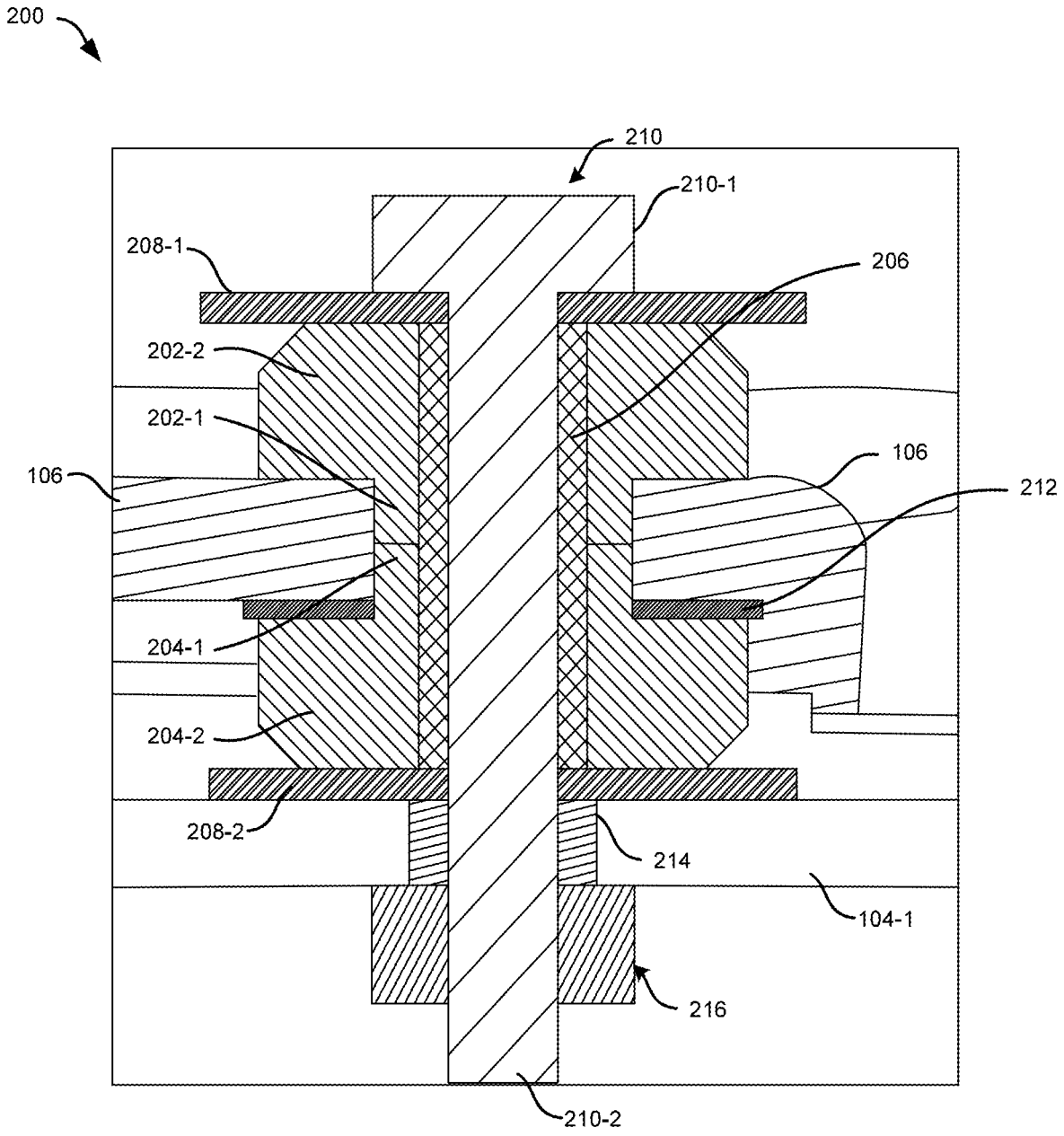
FIGS. 2A to 2D illustrate exemplary views of the first buffer in accordance with one or more embodiments of the subject disclosure.
Figure 2B:
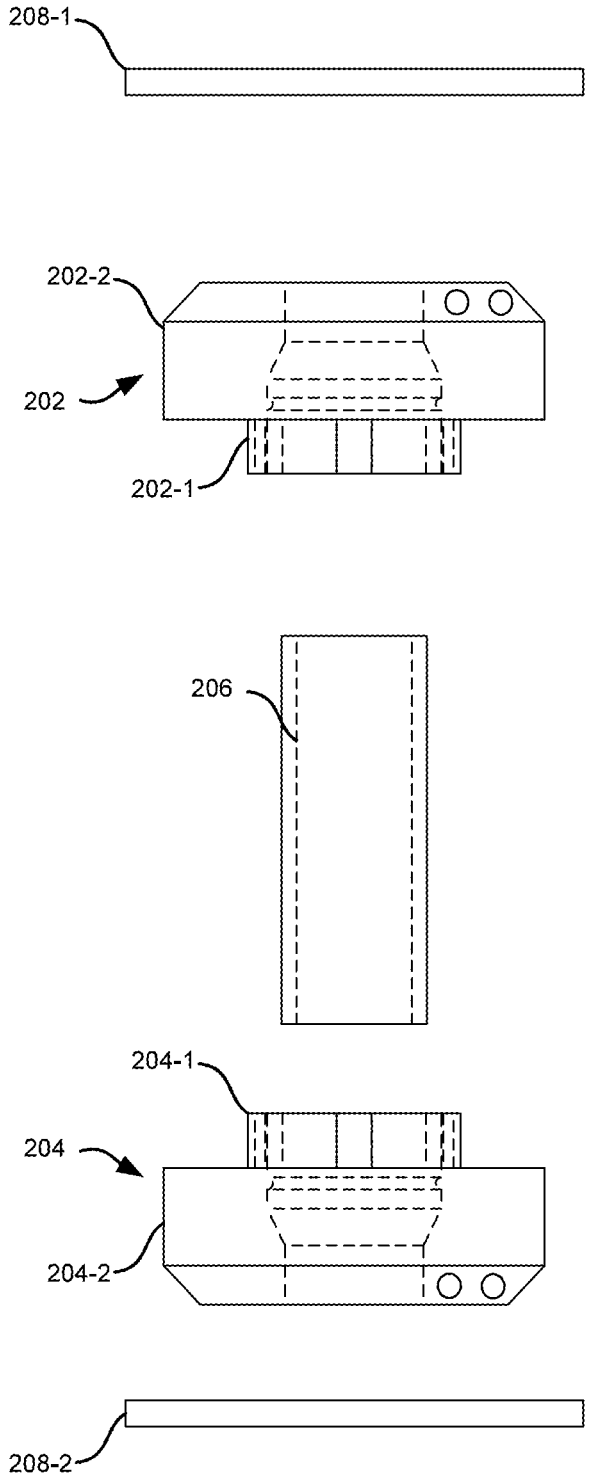
Figure 2C:
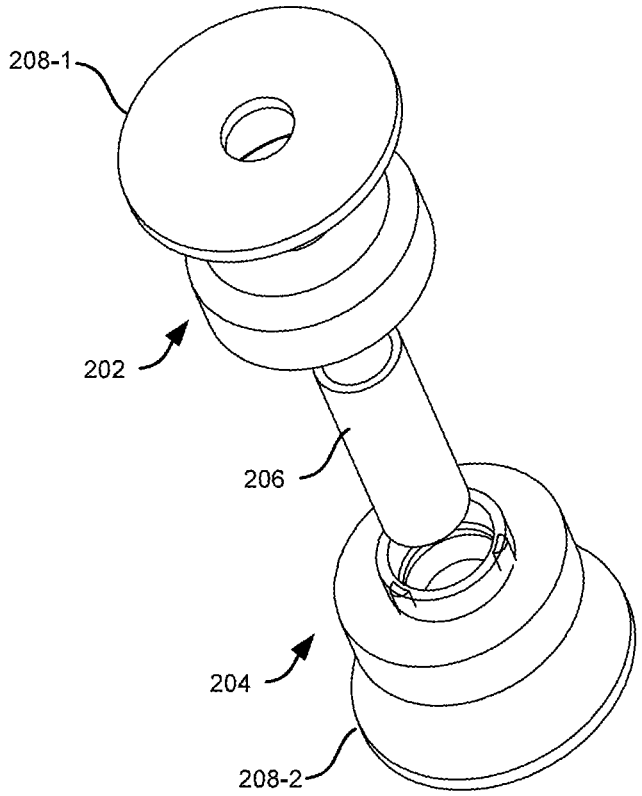
Figure 2D:
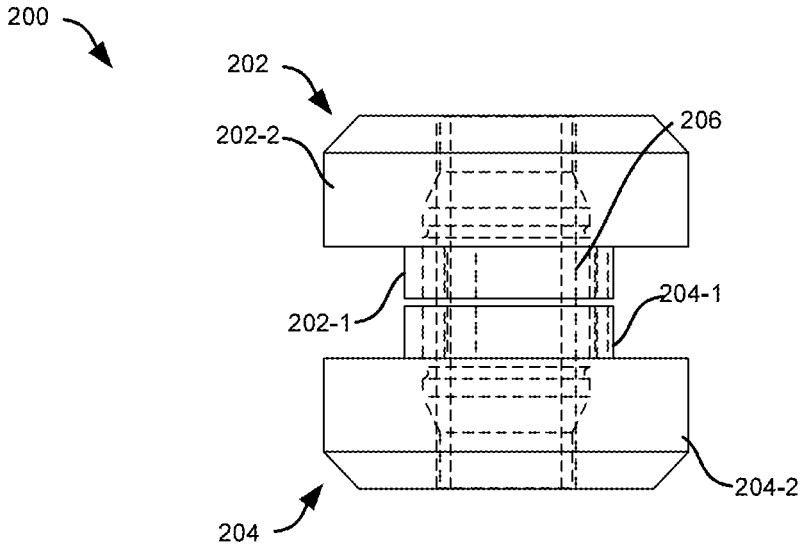

The following is a detailed description of embodiments of the subject disclosure depicted in the accompanying drawings. The embodiments are in such detail as to clearly communicate the subject disclosure. However, the amount of detail offered is not intended to limit the anticipated variations of embodiments; on the contrary, the intention is to cover all modifications, equivalents, and alternatives falling within the spirit and scope of the subject disclosure as defined by the appended claims.

Various terms are used herein. To the extent a term used in a claim is not defined below, it should be given the broadest definition persons in the pertinent art have given that term as reflected in printed publications and issued patents at the time of filing.

In the specification, reference may be made to the spatial relationships between various components and to the spatial orientation of various aspects of components as the devices are depicted in the attached drawings. However, as will be recognized by those skilled in the art after a complete reading of the subject disclosure, the components of this invention. described herein may be positioned in any desired orientation. Thus, the use of terms such as "above," "below," "upper," "lower," "first", "second" or other like terms to describe a spatial relationship between various components or to describe the spatial orientation of aspects of such components should be understood to describe a relative relationship between the components or a spatial orientation of aspects of such components, respectively, as the frame, compressor, first buffer, second buffer, and corresponding components, described herein may be oriented in any desired direction.

Transport refrigeration units (TRUs) play a crucial role in maintaining temperature-sensitive cargo within an optimal temperature range during transportation. These units utilize compressors to circulate refrigerant and manage the temperature within the insulated compartment. TRU may be fluidically coupled to ambient and an enclosed (cargo) space of a container or a trailer associated with a cargo-truck or other vehicle. Exemplary transportation cargo space includes a cargo area of a light commercial vehicle, a cargo trailer, a railroad car, an intermodal container (a shipping container). TRUs can also be used with auxiliary stationary units. The TRU may be configured to maintain a predefined thermal environment within the space. Variable-speed compressors have gained prominence due to their ability to adapt to varying cooling demands, providing enhanced energy efficiency and temperature control compared to traditional fixed-speed compressors.

However, the implementation of variable-speed compressors in TRUs has presented certain challenges. One of the key challenges is the excessive noise generated by the compressor when operating at high speeds. As the compressor speed increases, the noise and vibration levels can become uncomfortably high, leading to potential noise pollution concerns for both operators and bystanders. Additionally, prolonged exposure to excessive noise can have adverse effects on personnel in proximity to the TRU.

Furthermore, the operation of the variable-speed compressor at high speeds can negatively impact the structural integrity and stability of both the compressor and the TRU as a whole. The increased mechanical forces and vibrations associated with high-speed operation can lead to premature wear and tear of the components of the TRU and compressor. This accelerated deterioration can result in frequent maintenance and repair requirements, leading to increased downtime and operational costs. Moreover, the structural instability caused by vibrations can compromise the overall integrity of the TRU, potentially resulting in a reduced lifespan.

There is therefore a need for a solution to address the challenges posed by variable speed compressors in TRUS, by providing an improved and effective solution to stabilize the compressor, reduce compressor vibrations, and attenuate noise while operating at high speed.

Referring to FIGS. 1A to 1D, a vibration stabilizer assembly 100 (referred to as assembly 100, hereinafter) for a compressor 102 in a transport refrigeration unit (TRU) is illustrated. The assembly 100 can include a plurality of first buffers 200 (collectively referred to as first buffers 200 or bottom buffers 200 or first isolators 200, herein) configured between a bottom plate 106 associated with the compressor 102 and a frame 104-1 of the TRU. The compressor 102 can be a variable-speed compressor 102; however, the compressor 102 can also be a single-speed compressor 102. In one or more embodiments, the first buffers 200 can be configured between the bottom plate 106 and the frame 104-1 of the TRU using a bolt and nut assembly, such that there remains no contact between the bottom plate 106 of the compressor 102 and the frame 104-1, while the load or vibrations from the bottom plate 106 of the compressor 102 can be transferred to the frame 104-1 of the TRU via the bolt 210 and the first buffers 200, where the first buffers 200 can stabilize the vibrations.

The first buffer 200 can include an annular section and holes can be provided on the bottom plate 106 and the frame 104-1 to facilitate fastening of the bottom plate 106 and the frame 104-1 using the first buffer 200, and the bolt and nut assembly. In one or more embodiments, the first buffers 200 can include a rigid sleeve 206 made of steel but not limited to the like being configured coaxially and extending longitudinally through the annular section of the corresponding first buffer 200. In one or more embodiments, the first buffer 200 can be configured between the bottom plate 106 of the compressor 102 and the frame 104-1 of the TRU using the bolt and nut assembly, such that a head 210-1 of the bolt 210 rests on top of the first buffer 200, and a shank of the bolt 210 extends through the rigid sleeve 206 with a free end 210-2 of the shank extending at least partially outside from bottom of the frame 104-1 and further fastened using a nut 216, while the rigid sleeve 206 extending between the bottom of the head 210-1 of the bolt 210 and top of the frame 104-1. However, in one or more embodiments, the first buffer 200 can be configured between the bottom plate 106 of the compressor 102 and the frame 104-1 of the TRU using the bolt and nut assembly, such that a head 210-1 of the bolt 210 rests on bottom of the first buffer 200, and a shank of the bolt 210 extends through the rigid sleeve 206 with a free end 210-2 of the shank extending at least partially outside from the top of the frame 104-1 and further fastened using a nut 216, while the rigid sleeve 206 extending between the bottom of the head 210-1 of the bolt 210 and top of the frame 104-1. The detailed construction of the first buffer 200 has been described later in conjunction with FIGS. 2A to 2D.

In one or more embodiments, each of the first buffers 200 can have a predetermined profile and be made of an elastomer having an axial-to-radial stiffness ratio of 2:1, 3:1, or 4:1. In one or more embodiments, the first buffers 200 can have a radial stiffness of less than 1000 pounds per inch. In one or more embodiments, the first buffers 200 can have a radial stiffness of less than 600 pounds per inch. Further, in one or more embodiments, the first buffers 200 can have an axial stiffness ranging from 4000 to 600 pounds per inch and a radial stiffness ranging from 1000 to 300 pounds per inch. While various embodiments of this disclosure have been elaborated for the first buffer having a specific radial and axial stiffness, or specific axial-to-radial ratio, however, the teachings of this disclosure are equally applicable for the first buffers having any other values of radial stiffness, axial stiffness, or axial-to-radial stiffness, which may be selected based on the weight of the compressor, driving frequencies, operating speed of the compressor, and characteristics of the frame or structures on which the compressor is mounted, in order to optimize the isolation, and all such embodiments are well within the scope of this subject disclosure.

In one or more embodiments, the assembly 100 can include one or more clamping rings 108 extending around the top end of the compressor 102 and connected to each other. The assembly 100 can further include a mounting plate 110 coupled to at least one of the clamping rings 108 and further coupled to the frame 104-2 of the TRU, where the connection point 104-2 of the mounting plate 110 on the frame 104-1 of the TRU is different from the connection point 104-1 of the bottom plate 106 on the frame 104-1. The connection point 104-2 of the mounting plate 110 can be at a vertical section of the frame 104-1 and the connection point 104-1 of the bottom plate 106 can be at a bottom horizontal section of the frame 104-1 of the TRU.

Further, the mounting plate 110 can be coupled to the corresponding clamping ring 108 using at least one second buffer 300 (also referred to as second buffer 300 or top buffer 300 or second isolator 300, herein). In one or more embodiments, the second buffer 300 can be a stud mount made of an elastomer having a radial stiffness of less than 1000 pounds per inch. In one or more embodiments, each of the second buffer 300 can have an axial-to-radial stiffness ratio of 6:1. Further, in one or more embodiments, the second buffers 300 can have an axial stiffness ranging from 6000 to 600 pounds per inch, and the radial stiffness ranging from 1000 to 200 pounds per inch. While various embodiments of this disclosure have been elaborated for the second buffer having a specific radial and axial stiffness, or specific axial-to-radial ratio, however, the teachings of this disclosure are equally applicable for the second buffers having any other values of radial stiffness, axial stiffness, or axial-to-radial stiffness, which may be selected based on the weight of the compressor, driving frequencies, operating speed of the compressor, and characteristics of the frame or structures on which the compressor is mounted, in order to optimize the isolation, and all such embodiments are well within the scope of this subject disclosure.

Accordingly, the first (bottom) buffers 200 can minimize (or isolate) the transfer of load or vibrations between the bottom plate 106 to and frame 104-1 of the TRU, while the second (top) buffer(s) 300 can minimize (or isolate) the transfer of load or vibrations between the top of the compressor 102 and the frame 104-1 of the TRU.

In addition, the profiles or axial-to-radial stiffness ratios of the first buffers 200 and the second buffer(s) 300 can help stabilize the vibrations of the compressor 102 and attenuate the noises caused by the vibrations. Moreover, the rigid sleeve 206 extending through the first buffer 200 can prevent direct contact between the bottom plate 106 (of the compressor 102) and the frame 104-1 of the TRU or can withstand the impact/load of the bottom plate 106 on the frame 104-1 of the TRU in the event of failure of the elastomer of the first buffer 200, thereby acting as a fail-safe mechanism.

Referring to FIG. 2A to 2D, in one or more embodiments, the first buffer 200 can include a first member 202 that comprises a first cylindrical base 202-1 with a radially extending first flange 202-2, and a centrally located first annular section extending along a center axis of the first member 202, where the first cylindrical base 202-1 and the first flange 202-2 are an integral part of the first member 202, creating a unified structure. The first buffer 200 can further include a second member 204 that comprises a second cylindrical base 204-1 with a radially extending second flange 204-2, and a centrally located second annular section extending along the center axis of the first member 204, where the second cylindrical base 204-1 and the second flange 204-2 are an integral part of the second member 204, creating a unified structure. The first member 202 can be coaxially configured with the second member 204 such that the first cylindrical base 202-1 and the second cylindrical base 204-1 remain in contact, and the first annular section and the second annular section remain in line. In one or more embodiments, the first member 202 and second member 204 may be different structures, however, the first member 202 and second member 204 may also be integrally connected to form a single structure.

The assembly 100 can further include a plurality of first holes at first predefined positions on the bottom plate 106, and a plurality of second holes at second predefined positions on the frame 104-1 of the TRU. The first holes of the bottom plate 106 and the second holes of the frame 104-1 can be aligned in line to facilitate the fastening of the first buffers 200 to the bottom plate 106 and the frame 104-1 via the bolt 210 and the nut 216. In one or more embodiments, each of the first buffers 200 can be fastened to the bottom plate 106 and the frame 104-1 such that a rim area, around the first hole, of the corresponding bottom plate 106 can rest between the first flange 202-2 and the second flange 204-2, around the first cylindrical base 202-1 and the second cylindrical base 204-1 of the first buffers 200, while preventing contact between the bottom plate 106 and the frame 104-1. Accordingly, the radial load or vibrations from the bottom plate 106 can be radially transferred to the first and second cylindrical bases of the first buffer 200 and the axial load or vibrations from the bottom plate 106 can be axially transferred to the first and second flanges of the first buffer 200.

In addition, the assembly 100 can include a first washer 208-1 configured between the first flange 202-2 of the first buffer 200 and the head 210-1 of the bolt 210 to prevent direct contact between the bolt head 210-1 and the first buffer 200, and further evenly distribute the load of the bolt head 210-1 on the first flange 202-2. Further, the assembly 100 can include a second washer 208-2 of a second thickness configured between the second flange 204-2 and the top surface of the frame 104-1 to fill the gap (if any) between the bottom of the second flange 204-2 and the frame 104-1, which may not be needed if the compressor 102 is shorter. The second thickness can be selected based on the gap between the bottom of the second flange 204-2 and the frame 104-1 to firmly secure the first buffer 200 to the frame 104-1 and the bottom plate 106.

In one or more embodiments, the bolt 210 can extend through the rigid sleeve 206 associated with each of the first buffers 200 such that the head 210-1 of the bolt 210 rests on top of the first washer 208-1, and the shank of the bolt 210 extends through the rigid sleeve 206 with the free end 210-2 of the shank extending at least partially outside from bottom of the frame 104-1 and further fastened using the nut 216, while the rigid sleeve 206 extending between the first washer 208-1 and the second washer 208-2.

In one or more embodiments, the assembly 100 can include a spacer 212 of a first thickness (such as 1 mm but not limited to the like) configured between the bottom surface of the rim area of the bottom plate 106 and a top surface of the second flange 204-2 to fill a gap (if any) between the bottom plate 106 and the second member 204, however, the spacer 212 may not be needed if there is no gap between the bottom plate 106 and the second member 204. The spacer 212 can also evenly distribute the load of the rim area of the bottom plate 106 on the second flange 204-2 and also prevent the rim area from damaging the elastomer of the second flange 204-2. In one or more embodiments, the spacer 212 can be an annular member having an inner diameter equal to a diameter of the second annular section and an outer diameter greater than or equal to the diameter of the second flange 204-2.

In one or more embodiments, the assembly 100 can include an annular filler 214 disposed of in the second holes of the frame 104-1. The annular filler 214 can be configured to allow the bolt 210 to extend therethrough while restricting the movement of the bolt 210 with respect to the frame 104-1 in the corresponding second hole. However, the annular filler 214 may not be needed if there is no gap between the bolt 210 and the second holes of the frame 104-1 or if the bolt 210 remains firmly disposed in the second hole.

Referring back to FIGS. 1A to 1D, in one or more embodiments, the clamping rings 108 at the top of the compressor 102 can be fastened to each other using a first fastener 112 and the mounting plate 110 can be fastened to the frame 104-2 of the TRU using a second fastener 114. Further, as shown in FIG. 4, the two extreme ends of the mounting plate 110 can include a third hole 110-1 to facilitate the coupling of the mounting plate 110 to the clamping ring 108 using a pair of the second buffers 300. Further, a fourth hole(s) 110-2 can be provided in the middle of the mounting plate 110 to facilitate the coupling of the mounting plate 110 to the frame 104-1 using the second fastener 114. The mounting plate 110 can further include reinforced flanges 110-3, 110-4 extending from the mounting plate 110. In one or more embodiments, the second buffer 300 can be a stud mount as shown in FIGS. 3A and 3B and the first and second fasteners 112, 114 can include a nut and bolt assembly.

Figure 3A:
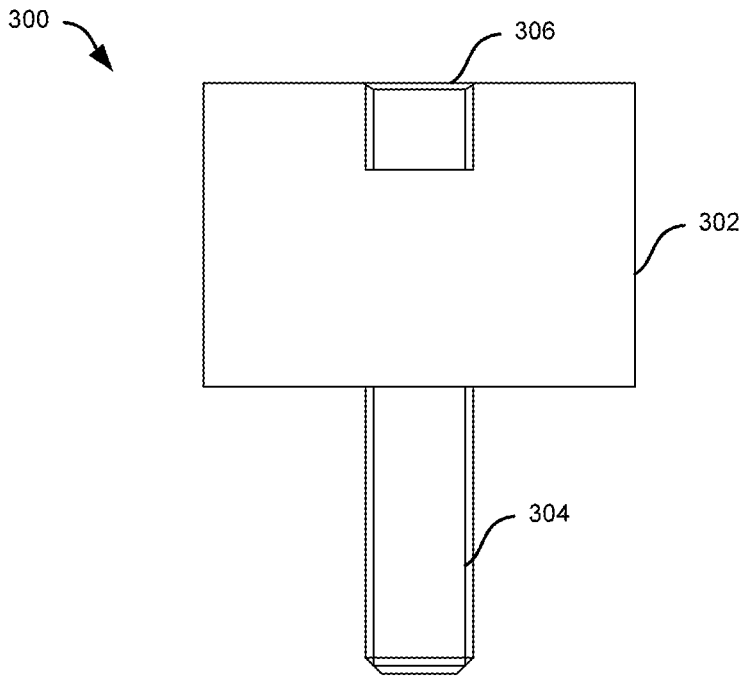
FIGS. 3A and 3B illustrate exemplary views of the second buffer in accordance with one or more embodiments of the subject disclosure.
Figure 3B:
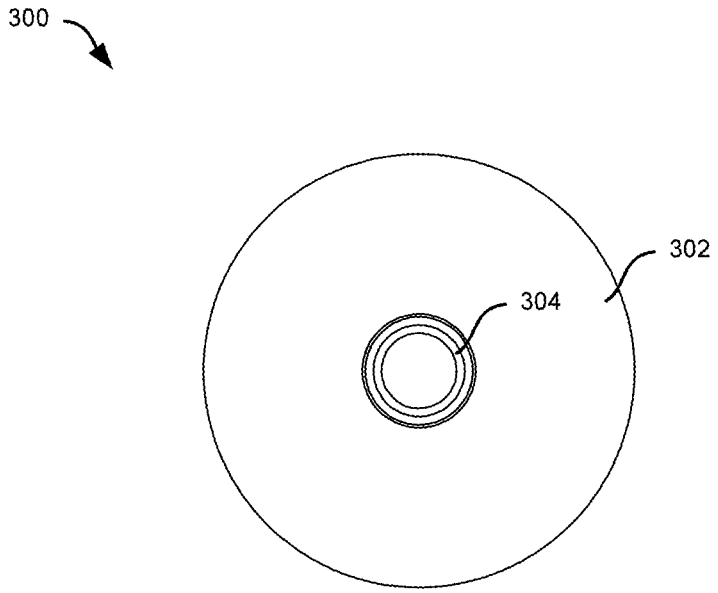
Figure 4:
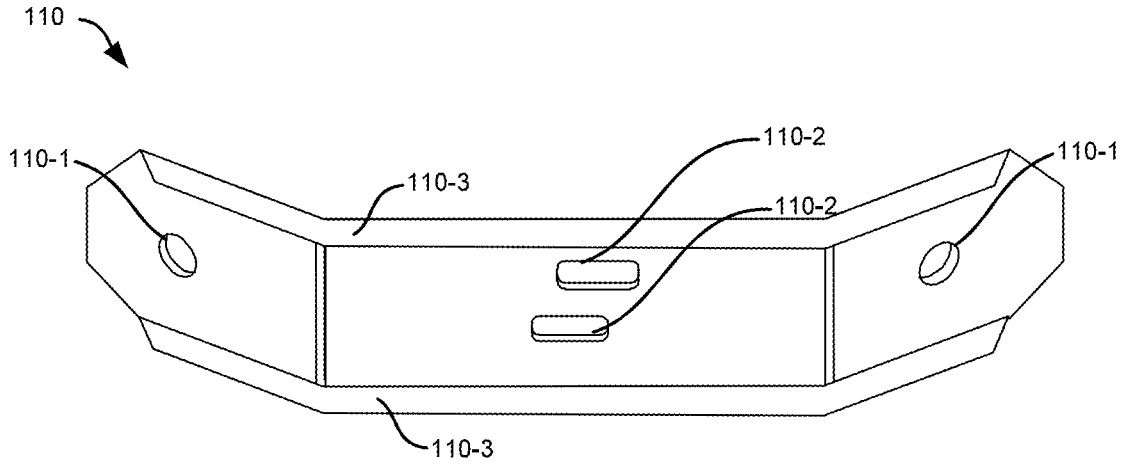
FIG. 4 illustrates an exemplary view of the top mounting plate in accordance with one or more embodiments of the subject disclosure.

Referring to FIGS. 3A and 3B, in one or more embodiments, the second (top) buffer 300 or stud mount 300 can include a base plate 302 made of elastomer and a stud element 304 protruding perpendicularly from the base plate 302. The base plate 302 can include apertures 306 at a first end with the stud element 304 protruding perpendicularly from a second end (opposite to the first end) of the base plate 302. The aperture 306 can facilitate the fastening of the base plate 302 or second buffer 300 to the clamping rings 108. The second buffer 300 can be configured between the mounting plate 110 and the clamping rings 108 such that the first end of the base plate 302 remains in contact with the clamping rings 108 and the stud element 304 extends through the third hole 110-1 of the mounting plate 110 with the base plate 302 firmly secured between the clamping ring 108 and the mounting plate 110 to form a buffer. The extending stud element 304 can be further glued or fastened to the mounting plate 110.

It should be obvious to a person skilled in the art that while various embodiments and drawings of this subject disclosure have been elaborated for the assembly having a specific number of first buffers and second buffers, however, the teachings of this subject disclosure are equally applicable for a different number of first and second buffers based on the dimension of the compressor, and all such embodiments are well within the scope of this subject disclosure. Further, while various embodiments of this subject disclosure have been elaborated for the assembly having the first buffer having a specific shape and the second buffers being a stud mount, however, the teachings of this subject disclosure are equally applicable for different designs of first buffers and second buffers having the axial-to-radial ratios of 4:1 and 6:1 respectively, and all such embodiments are well within the scope of this subject disclosure. Furthermore, while various embodiments of this subject disclosure have been elaborated for the assembly for stabilizing vibrations of compressor in a TRU, however, the teachings of this subject disclosure are equally applicable for the compressors installed in HVAC systems and the like, and all such embodiments are well within the scope of this subject disclosure Thus, this invention (fluid distributor) overcomes the drawbacks, limitations, and shortcomings associated with existing variable speed compressors in TRUs, by providing an improved and effective assembly that stabilizes the compressor, reduces compressor vibrations, and attenuates noise while operating at high speed.

While the subject disclosure has been described with reference to exemplary embodiments, it will be understood by those skilled in the art that various changes may be made and equivalents may be substituted for elements thereof without departing from the scope of the subject disclosure as defined by the appended claims. Modifications may be made to adopt a particular situation or material to the teachings of the subject disclosure without departing from the scope thereof. Therefore, it is intended that the subject disclosure not be limited to the particular embodiment disclosed, but that the subject disclosure includes all embodiments falling within the scope of the subject disclosure as defined by the appended claims.

In interpreting the specification, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

Without excluding further possible embodiments, certain example embodiments are summarized in the following clauses:

Clause 1. A vibration stabilizer assembly for a compressor in a transport refrigeration unit (TRU), the assembly comprising: one or more clamping rings extending around a top end of the compressor and connected to each other; and a mounting plate coupled to at least one of the clamping rings and a frame of the TRU, wherein the mounting plate is coupled to the corresponding clamping ring using at least one second buffer, wherein the at least one second buffer has a radial stiffness of less than 1000 pounds per inch.

Clause 2: The assembly of the preceding clause, each of the first buffers comprises a rigid sleeve configured coaxially and extending longitudinally through the corresponding first buffer.

Clause 3: The assembly of any one of the preceding clauses, wherein each of the first buffers has an axial stiffness ranging from 4000 to 600 pounds per inch and the radial stiffness ranging from 1000 to 300 pounds per inch, and wherein the at least one second buffer has an axial stiffness ranging from 6000 to 600 pounds per inch and the radial stiffness ranging from 1000 to 200 pounds per inch.

Clause 4: The assembly of any one of the preceding clauses, wherein the at least one second buffer is a stud mount comprising a base plate and a stud element protruding perpendicularly from the base plate.

The invention claimed is:

1. A vibration stabilizer assembly for a compressor in a transport refrigeration unit (TRU), the assembly comprising:

a plurality of first buffers configured between a bottom plate associated with the compressor and a frame of the transport refrigeration unit, wherein each of the first buffers has a radial stiffness of less than 1000 pounds per inch, Wherein each of the first buffers comprise a rigid sleeve configured coaxially and extending longitudinally through a first annular section and a second annular section of the corresponding first buffer.

2. The assembly of claim 1, wherein each of the first buffers has a radial stiffness of less than 600 pounds per inch.

3. The assembly of claim 1, wherein each of the first buffers has a radial stiffness of less than 400 pounds per inch.

4. The assembly of claim 1, wherein each of the first buffers has an axial-to-radial stiffness ratio of 2:1, 3:1, or 4:1.

5. The assembly of claim 1, wherein each of the first buffers comprises:

a first member comprising a first cylindrical base with a radially extending first flange, and a centrally located first annular section extending along a center axis of the first member;

a second member comprising a second cylindrical base with a radially extending second flange, and a centrally located second annular section extending along a center axis of the first member;

wherein the first member is coaxially configured with the second member such that the first cylindrical base and the second cylindrical base remain in contact, and the first annular section and the second annular section remain in line.

6. The assembly of claim 5, wherein the assembly comprises a bolt extending through a rigid sleeve associated with each of the first buffers such that a head of the bolt rests on top of the first flange, a free end of the bolt extends at least partially outside from a bottom of the frame through the second flange, and the rigid sleeve extends between a bottom of the head of the bolt and a top surface of the frame, and wherein the free end of the bolt is fastened using a nut to secure the corresponding first buffer to the bottom plate and the frame.

7. The assembly of claim 6, wherein the assembly comprises:

a plurality of first holes at first predefined positions on the bottom plate; and a plurality of second holes at second predefined positions on the frame of the transport refrigeration unit, wherein the first holes of the bottom plate and the second holes of the frame are aligned in line to facilitate fastening of the plurality of first buffers to the bottom plate and the frame via the bolt and the nut.

8. The assembly of claim 7, wherein each of the first buffers is fastened to the bottom plate and the frame such that a rim area, around a hole of the plurality of first holes, of the corresponding bottom plate rests between the first flange and the second flange, around the first cylindrical base and the second cylindrical base, while preventing contact between the bottom plate and the frame.

9. The assembly of claim 8, wherein the assembly comprises a spacer of a first thickness configured between a bottom surface of the rim area and a top surface of the second flange.

10. The assembly of claim 8, wherein the assembly comprises:

a first washer configured between the first flange and the head of the bolt; and a second washer of a second thickness configured between the second flange and a top surface of the frame, wherein the second thickness is selected based on a gap between the bottom of the second flange and the frame, wherein the rigid sleeve extends between the first washer and the second washer.

11. The assembly of claim 7, wherein the assembly comprises an annular filler disposed of in the plurality of second holes, wherein the annular filler is configured to allow the bolt to extend therethrough while restricting movement of the bolt with respect to the frame in the corresponding second hole.

12. The assembly of claim 1, wherein the assembly comprises:

one or more clamping rings extending around a top end of the compressor and connected to each other; and a mounting plate coupled to at least one of the clamping rings and the frame of the transport refrigeration unit, wherein the mounting plate is coupled to the corresponding clamping ring using at least one second buffer, wherein the at least one second buffer has a radial stiffness of less than 1000 pounds per inch.

13. The assembly of claim 12, wherein the at least one second buffer has an axial-to-radial stiffness ratio of 6:1.

14. The assembly of claim 1, wherein each of the first buffers has an axial stiffness ranging from 4000 to 600 pounds per inch and the radial stiffness ranging from 1000 to 300 pounds per inch, and wherein the at least one second buffer has an axial stiffness ranging from 6000 to 600 pounds per inch and the radial stiffness ranging from 1000 to 200 pounds per inch.

15. A vibration stabilizer assembly for a compressor in a transport refrigeration unit (TRU), the assembly comprising:

one or more clamping rings extending around a top end of the compressor and connected to each other; and a mounting plate coupled to at least one of the clamping rings and a frame of the transport refrigeration unit, wherein the mounting plate is coupled to the corresponding clamping ring using at least one second buffer, wherein the at least one second buffer has a radial stiffness of less than 1000 pounds per inch, wherein each of the first buffers comprises a rigid sleeve configured coaxially and extending longitudinally through a first annular section and a second annular section of the corresponding first buffer.

16. The assembly of claim 15, wherein the at least one second buffer has an axial-to-radial stiffness ratio of 6:1.

17. The assembly of claim 15, wherein two ends of the mounting plate are coupled to the corresponding clamping ring using a pair of the second buffers, and wherein the mounting plate is further coupled to the frame using a fastener.

18. The assembly of claim 15, wherein the assembly comprises a plurality of first buffers configured between a bottom plate associated with the compressor and the frame of the transport refrigeration unit, wherein each of the first buffers has a radial stiffness of less than 1000 pounds per inch.

19. The assembly of claim 15, wherein each of the first buffers has an axial-to-radial stiffness ratio of 2:1, 3:1, or 4:1.

* * * * *